US008632155B2

(12) United States Patent
Ueno

(10) Patent No.: US 8,632,155 B2
(45) Date of Patent: Jan. 21, 2014

(54) IMAGE FORMING APPARATUS

(75) Inventor: Fumihiro Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 13/051,947

(22) Filed: Mar. 18, 2011

(65) Prior Publication Data

US 2011/0249052 A1 Oct. 13, 2011

(30) Foreign Application Priority Data

Apr. 7, 2010 (JP) ..... 2010-088796

(51) Int. Cl.
*B41J 29/38* (2006.01)

(52) U.S. Cl.
USPC ..... 347/16

(58) Field of Classification Search
None
See application file for complete search history.

(56) References Cited

U.S. PATENT DOCUMENTS

| | | | | |
|---|---|---|---|---|
| 7,525,564 | B2 | 4/2009 | Okamoto | |
| 2004/0022566 | A1 * | 2/2004 | Matsuyama et al. | 399/404 |
| 2006/0209155 | A1 * | 9/2006 | Hwang et al. | 347/104 |
| 2006/0269339 | A1 * | 11/2006 | Okamoto et al. | 399/401 |
| 2008/0258380 | A1 * | 10/2008 | Okumura et al. | 271/258.01 |

FOREIGN PATENT DOCUMENTS

| | | | |
|---|---|---|---|
| CN | 1477042 | A | 2/2004 |
| CN | 1837969 | A | 9/2006 |
| JP | 2001-106426 | A | 4/2001 |
| JP | 2004-059300 | A | 2/2004 |
| JP | 2005-067831 | A | 3/2005 |

* cited by examiner

*Primary Examiner* — Geoffrey Mruk
*Assistant Examiner* — Bradley Thies
(74) *Attorney, Agent, or Firm* — Canon USA Inc., IP Division

(57) ABSTRACT

An image forming apparatus includes an image forming unit, a stacking unit, a first detection unit, a second detection unit, and a control unit. The image forming unit forms an image on a recording medium. The stacking unit stacks recording media on which images are formed. The first detection unit detects a conveyance interval between a trailing edge of a first recording medium and a leading edge of a second recording medium conveyed subsequent to the first recording medium conveyance. The second detection unit is disposed downstream of the first detection unit and detects the conveyance interval and detects whether an amount of recording media stacked on the stacking unit exceeds a predetermined amount. The control unit changes, according to a result of comparing detected conveyance intervals, conveyance timing of the second recording medium to widen the conveyance interval detected by the first detection unit.

10 Claims, 10 Drawing Sheets

IMAGE FORMING APPARATUS

BACKGROUND OF THE INVENTION

1. Field of the Invention

The present invention relates to a method for controlling a sheet-to-sheet interval between a preceding sheet and a subsequent sheet in an image forming apparatus such as a laser beam printer, a copying machine, and an inkjet printer.

2. Description of the Related Art

Conventionally, an image forming apparatus includes a stacking unit for stacking recording media on which images have been formed. The image forming apparatus detects the amount of recording media stacked on the stacking unit, and if the detected amount exceeds a predetermined amount, the image forming apparatus determines that the recording media are fully stacked on the stacking unit. The image forming apparatus then stops performing the image forming process.

For example, Japanese Patent Application Laid-Open No. 2001-106426 discusses disposing a flag and a sensor in a discharge port of the stacking unit for detecting whether the recording media have passed through the discharge port. If the detected time for the recording media to pass through the discharge port is longer than a predetermined time, the image forming apparatus determines that the amount of the recording media stacked on the stacking unit has exceeded a predetermined amount. The image forming apparatus thus determines that the stacking unit is fully stacked.

However, in recent years, the number of sheets on which images are formed per unit time has been increased to improve productivity. For example, the sheets are conveyed by reducing a sheet-to-sheet interval that is an interval between a preceding sheet and a subsequent sheet. In such a case, there may not be enough time for confirming whether the recording media are fully stacked on the stacking unit depending on a response time of the sensor, i.e., a detection unit of the stacking unit. As a result, the image forming apparatus may incorrectly determine the fully-stacked state. For example, if the subsequent sheet reaches the flag before the status of the flag has changed after the preceding sheet has passed through the flag, an output from the sensor does not change. The image forming apparatus may thus falsely detect that the stacking unit is in the fully-stacked state even when the recording media are not fully stacked, and may stop performing the image forming process.

SUMMARY OF THE INVENTION

The present invention is directed to reducing false detection of the fully-stacked state by a detection unit that may be caused by a decrease in the sheet-to-sheet interval between the preceding sheet and the subsequent sheet in the image forming apparatus.

According to an aspect of the present invention, an image forming apparatus includes an image forming unit, a stacking unit, a first detection unit, a second detection unit, and a control unit. The image forming unit forms an image on a recording medium. The stacking unit stacks recording media on which images are formed by the image forming unit. The first detection unit detects a conveyance interval between a trailing edge of a first recording medium that is first conveyed and a leading edge of a second recording medium conveyed subsequent to the first recording medium. The second detection unit is disposed downstream of the first detection unit with respect to a conveying direction of a recording medium and detects the conveyance interval and detects whether an amount of recording media stacked on the stacking unit exceeds a predetermined amount. The control unit changes, according to a result of comparing the conveyance interval detected by the first detection unit and the conveyance interval detected by the second detection unit, conveyance timing of the second recording medium to widen the conveyance interval detected by the first detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
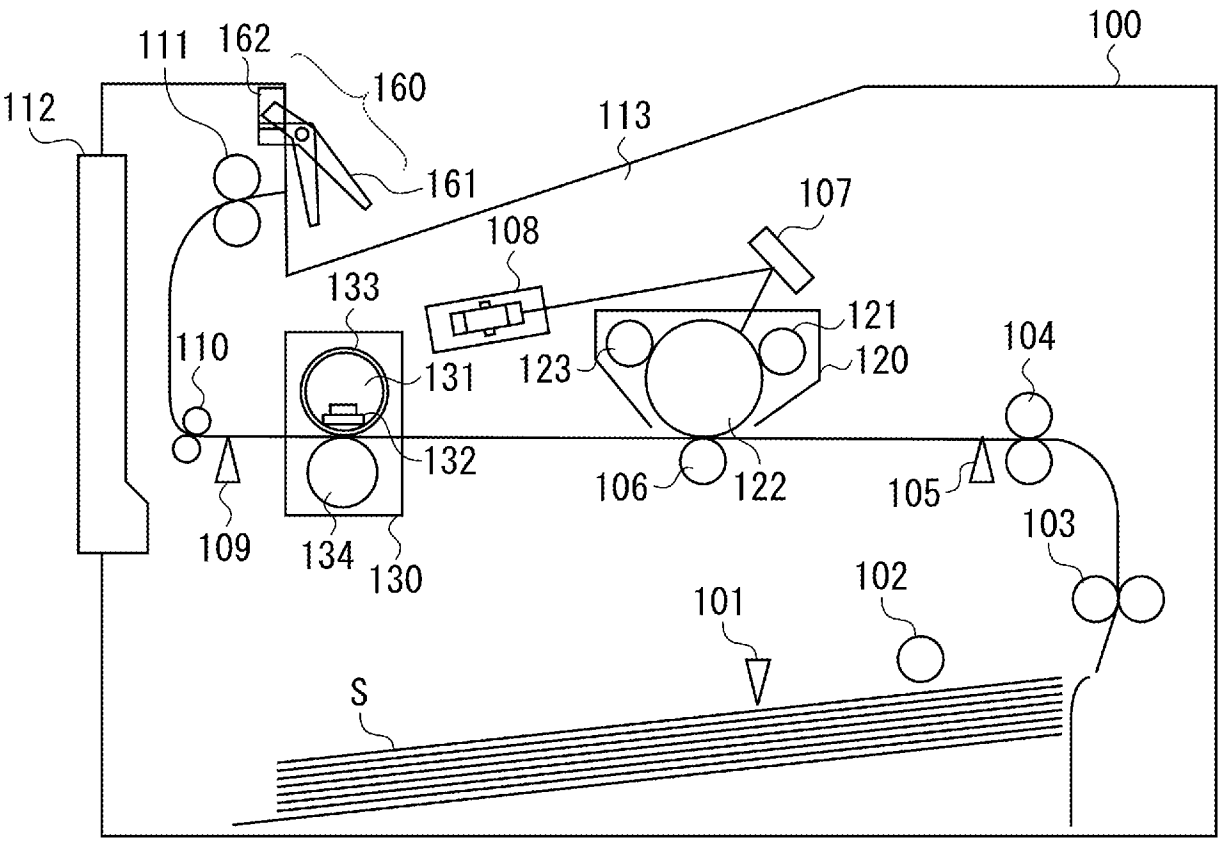
FIG. 1 is a schematic cross-sectional view illustrating an image forming apparatus according to an exemplary embodiment.

FIG. 1 is a schematic cross-sectional view illustrating an image forming apparatus according to an exemplary embodiment. An image forming apparatus may include any machine that may convey a visual representation to a sheet, such as a laser beam printer, a copying machine, an inkjet printer, a digital photocopier, and a multifunction printer. Referring to FIG. 1, sheets S are recording media. Recording media may include a physical device, such as a sheet, having a surface that would hold a marking substance. Hereinafter, a recording medium S that is first conveyed will be referred to as a preceding sheet S1, and the recording medium S that is conveyed subsequent to the preceding sheet S1 will be referred to as a subsequent sheet S2. A recording medium sensor 101 detects whether the recording media S are stacked on a sheet feed cassette. The recording media S may be considered stacked on a sheet feed cassette, for example, if the recording media S are arranged in an orderly pile on the sheet feed cassette. If the recording medium sensor 101 detects that the recording media S are stacked on a sheet feed cassette, a sheet feed roller 102 starts to feed the sheets. The recording media S fed by the sheet feed roller 102 are conveyed by a conveyance roller 103 and a registration roller 104. A conveyance path sensor 105 detects a leading edge of the conveyed recording medium S and a trailing edge of the conveyed recording medium S, so that the sheet-to-sheet interval, i.e., the conveyance interval between detection of the trailing edge of the preceding sheet S1 and the leading edge of the subsequent sheet S2, can be detected.

The recording medium S which is conveyed through the conveyance path sensor 105 is conveyed to an image forming unit including a transfer roller 106, a reflecting mirror 107, a light-scanning device 108, a cartridge 120, a developing roller 121, a photosensitive drum 122, and a charging roller 123. The image forming unit performs an image forming process by causing the charging roller 123 to charge a surface of the photosensitive drum 122 with a uniform potential. The light-scanning device 108 irradiates via the reflecting mirror 107 a surface of the photosensitive drum 122 with laser beam according to image information. The light-scanning device 108 thus forms a latent image on the photosensitive drum 122. The developing roller 121 then develops the latent image and forms a toner image. The formed toner image is transferred to the recording medium S when the recording medium S passes between the photosensitive drum 122 and the transfer roller 106.

A fixing device 130 includes a thermistor 131 that detects temperature of a heater 132, the heater 132, a fixing film 133, and a pressing roller 134. After the transfer roller 106 transfers the toner image on the recording medium S, the recording medium S passes between the fixing film 133 and the pressing roller 134 so that the toner image is heat-pressed and fixed to the recording medium S. The recording medium S on which the toner image is fixed is conveyed to a fixed sheet discharge sensor 109, then conveyed to a fixed sheet discharge roller 110 and a sheet discharge roller 111, and discharged to a sheet discharge tray 113. If a sheet discharge tray 112 is open, the recording medium S can be discharged to the sheet discharge tray 112.

A full stack detection sensor 160 is fixed on a discharge port of the sheet discharge tray 113. The full stack detection sensor 160 is disposed downstream of the conveyance path sensor 105 with respect to the conveying direction of the recording medium, and includes a flag 161 and a photointerrupter 162. The flag 161 covering the photointerrupter 162 can detect the stacked state of the recording media S in the sheet discharge tray 113. For example, if it is detected that the flag 161 is covering the photointerrupter 162 for a predetermined time, it is determined that the recording media S are fully stacked on the sheet discharge tray 113. Further, the full stack detection sensor 160 can detect the sheet-to-sheet interval. According to the present exemplary embodiment, whether the recording media are fully-stacked may be determined based on whether a height of the recording media S stacked on the sheet discharge tray 113 has reached a predetermined height. The predetermined height is lower than where the sheet discharge port is positioned.

Figure 2:
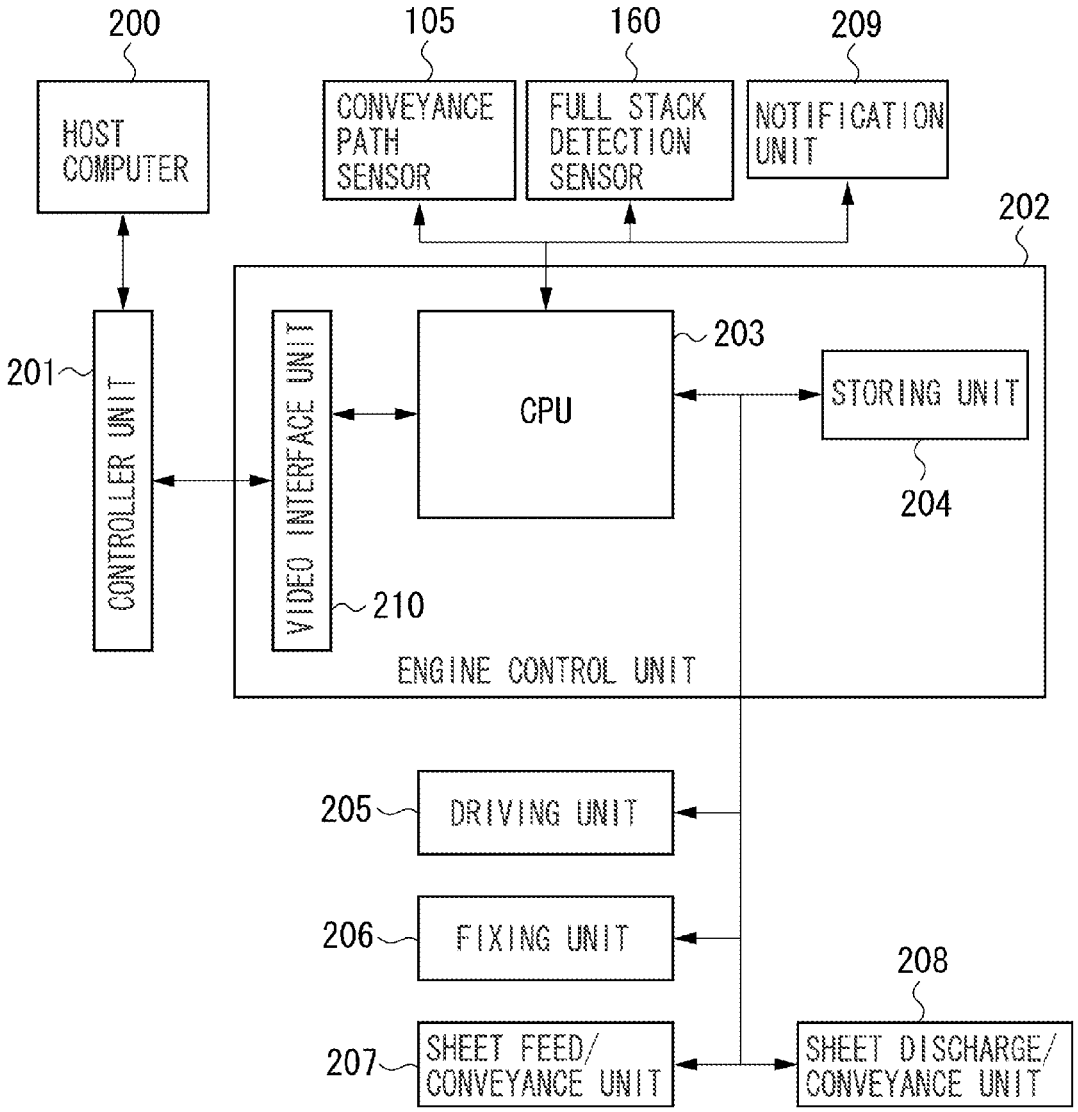
FIG. 2 is a block diagram illustrating a control unit of an image forming apparatus according to an exemplary embodiment.

FIG. 2 is a block diagram illustrating a control unit of the image forming apparatus 100. Referring to FIG. 2, a host computer 200 transmits a print command to a controller unit 201. The controller unit 201 transmits to an engine control unit 202 a print reservation command or a print start command, according to the print command received from the host computer 200.

The engine control unit 202 receives, via a video interface unit 210, commands and image forming information such as data transmitted from the controller unit 201. The engine control unit 202 then controls using a central processing unit (CPU) 203 an operation of the image forming apparatus 100, based on the received image forming information. The CPU 203 includes a read only memory (ROM) (not illustrated) that stores a control program, a random access memory (RAM) (not illustrated) that stores data, and a gate element (not illustrated). The CPU 203 controls each portion of an engine according to control procedures stored in the ROM. Further, the CPU 203 controls, based on the image forming information, a driving unit 205 that drives each component in the image forming apparatus 100, a fixing unit 206, a sheet feed/conveyance unit 207 that feeds and conveys the recording medium S, and a sheet discharge/conveyance unit 208 that conveys and discharges the recording medium S. Furthermore, the CPU 203 receives results of detecting the sheet-to-sheet interval from the conveyance path sensor 105 and full stack detection sensor 160. The CPU 203 stores the received detection results in a storing unit 204.

Figure 3:
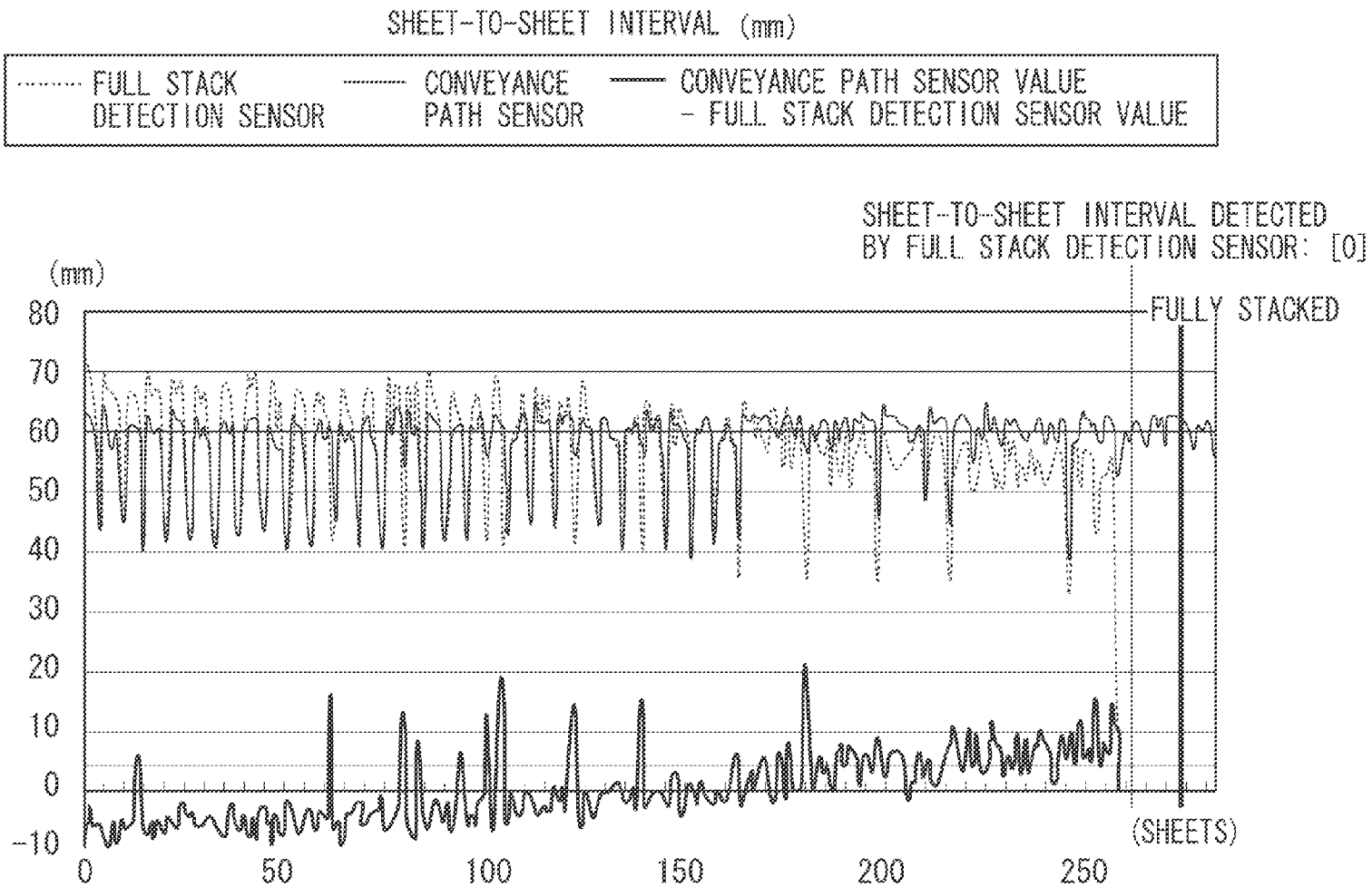
FIG. 3 is a graph illustrating sheet-to-sheet intervals detected by a conveyance path sensor and a full stack detection sensor, and difference values between the detected sheet-to-sheet intervals.

FIG. 3 is a graph illustrating values of the detected sheet-to-sheet intervals, i.e., the intervals between the trailing edge of the preceding sheet S1 and the leading edge of the subsequent sheet S2, detected by the conveyance path sensor 105 and the full stack detection sensor 160. Further, FIG. 3 illustrates difference values between the sheet-to-sheet intervals detected by each of the sensors. The values are detected when continuous printing is performed and the sheet-to-sheet interval is short (detected at an interval of 56 mm as an example). Width (unit: mm) is indicated on a vertical axis, and a number of continuously printed sheets (unit: sheets) is indicated on a horizontal axis.

Referring to FIG. 3, when the stacking amount of the recording media S on the sheet discharge tray 113 is small, the stacking amount of the recording media S does not affect the operation of the flag 161 in the full stack detection sensor 160. The sheet-to-sheet intervals detected by the conveyance path sensor 105 and the full stack detection sensor 160 thus become nearly the same value (i.e., the difference value is 0) with a small margin of error. On the other hand, if the stacking amount of the recording media S on the sheet discharge tray 113 becomes large, the flag 161 may be delayed in returning to the original position after the recording medium S passes through the full stack detection sensor 160, due to curling of the recording media S. In such a case, the sheet-to-sheet interval detected by the full stack detection sensor 160 often becomes shorter than the sheet-to-sheet interval detected by the conveyance path sensor 105 (i.e., the difference value becomes greater than 0).

The decrease in the sheet-to-sheet interval detected by the full stack detection sensor 160 is caused by the effect of the stacking amount of the recording media S. Such a phenomenon thus occurs more frequently as the stacking amount of the recording media S on the sheet discharge tray 113 becomes closer to the fully-stacked state, i.e., the state in which the predetermined amount of the recording media S is stacked. If the value of the sheet-to-sheet interval detected by the full stack detection sensor 160 is small, stop time of the flag 161 becomes short. The full stack detection sensor 160 determines whether the recording media S are fully stacked on the sheet discharge tray 113 by detecting that the flag 161 has stopped moving for a predetermined time. If the value of the detected sheet-to-sheet interval is short, the time necessary for detecting the fully-stacked state cannot be secured. To solve such a problem, if it is detected that the sheet-to-sheet interval detected by the full stack detection sensor 160 is becoming short, sheet feeding timing is controlled to widen the sheet-to-sheet interval, so that the time necessary for detecting the fully-stacked state can be secured. Control of the timing for widening the sheet feeding interval will be described below.

Figure 4:
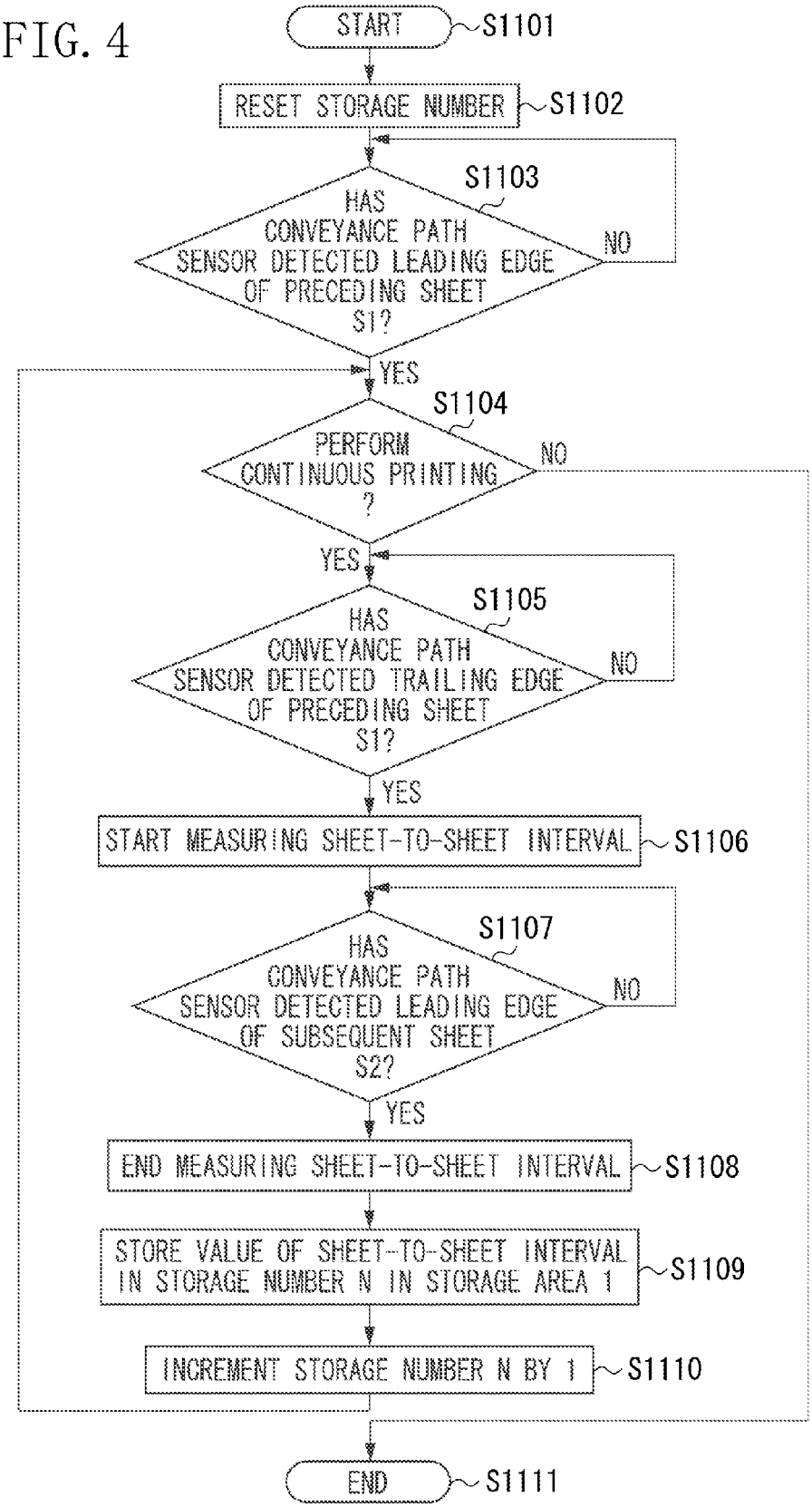
FIG. 4 is a flowchart illustrating a method for detecting a sheet-to-sheet interval using the conveyance path sensor.

FIG. 4 is a flowchart illustrating a method for detecting the sheet-to-sheet interval performed by the conveyance path sensor 105. In step S1101, the CPU 203 starts the image forming process. In step S1102, the CPU 203 resets a storage number for storing data in the storing unit 204. In step S1103, the CPU 203 determines whether the conveyance path sensor 105 has detected the leading edge of the preceding sheet S1. If the CPU 203 determines that the conveyance path sensor 105 has not detected the leading edge of the preceding sheet S1 (NO in step S1103), the process returns to step S1103. If the CPU 203 determines that the conveyance path sensor 105 detects the leading edge of the preceding sheet S1 (YES in step S1103), the process proceeds to step S1104. In step S1104, the CPU 203 determines whether there is a command to continuously perform the image forming process. If the CPU 203 determines that the image forming process is not to be continuously performed (NO in step S1104), the sheet-to-sheet interval cannot be detected. The process thus proceeds to step S1111, and the sheet-to-sheet interval detection ends.

On the other hand, if the CPU 203 determines that the image forming process is to be continuously performed (YES in step S1104), the process proceeds to step S1105. In step S1105, the CPU 203 determines whether the conveyance path sensor 105 has detected the trailing edge of the preceding sheet S1. If the CPU 203 determines that the conveyance path sensor 105 has not detected the trailing edge of the preceding sheet S1 (NO in step S1105), the process returns to step S1105. If the CPU 203 determines that the conveyance path sensor 105 has detected the trailing edge of the preceding sheet S1 (YES in step S1105), the process proceeds to step S1106. In step S1106, the CPU 203 starts measuring the sheet-to-sheet interval. In step S1107, the CPU 203 determines whether the conveyance path sensor 105 has detected the leading edge of the subsequent sheet S2. If the CPU 203 determines that the conveyance path sensor 105 has not detected the leading edge of the subsequent sheet S2 (NO in step S1107), the process returns to step S1107. If the CPU 203 determines that the conveyance path sensor 105 has detected the leading edge of the subsequent sheet S2 (YES in step S1107), the process proceeds to step S1108. In step S1108, the CPU 203 ends measuring the sheet-to-sheet interval. In step S1109, the CPU 203 stores the value of the measured sheet-to-sheet interval in a storage number N in a storage area 1 in the storing unit 204. In step S1110, the CPU 203 increments the storage number N by 1. From step S1110, the process returns to step S1104. The CPU 203 detects the sheet-to-sheet intervals by repeating the processes of step S1104 to step S1110 while the image forming process is continually performed. In other words, while the CPU 203 determines in S1104 that there is a command to continuously perform the image forming process (YES in step S1104), the CPU 203 detects the sheet-to-sheet intervals. The storage area and the storage number may be arbitrarily set.

Figure 5:
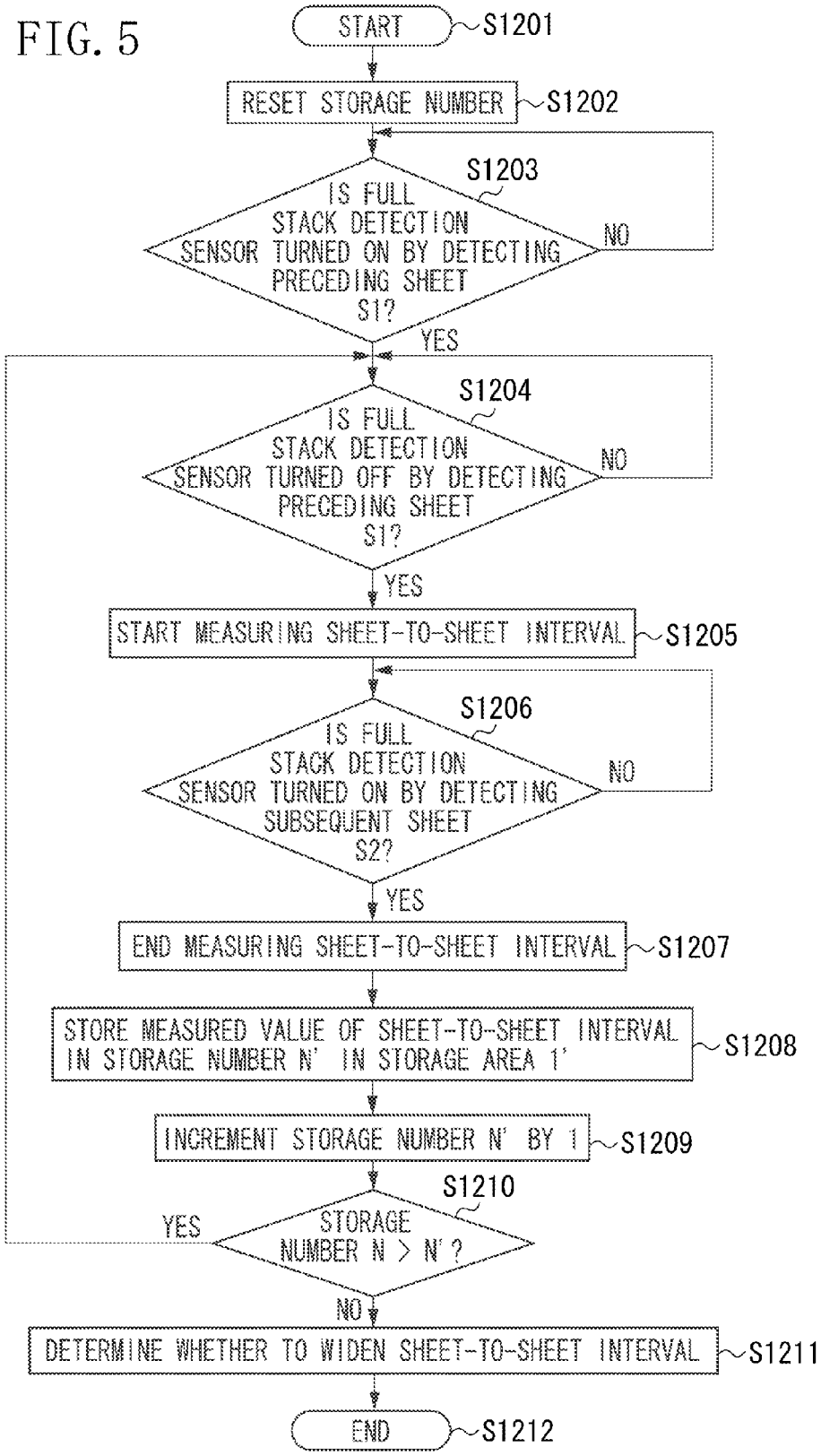
FIG. 5 is a flowchart illustrating a method for detecting a sheet-to-sheet interval using the full stack detection sensor.

FIG. 5 is a flowchart illustrating a method for detecting the sheet-to-sheet interval performed by the full stack detection sensor 160. In step S1201, the CPU 203 starts the image forming process. In step S1202, the CPU 203 resets the storage number for storing data in the storing unit 204. In step S1203, the CPU 203 determines whether the full stack detection sensor 160 has been turned on, i.e., has detected the preceding sheet S1.

If the CPU 203 determines that the full stack detection sensor 160 has not been turned on (NO in step S1203), the process returns to step S1203. If the CPU 203 determines that the full stack detection sensor 160 has detected the preceding sheet S1 (YES in step S1203), the process proceeds to step S1204. In step S1204, the CPU 203 determines whether the full stack detection sensor 160 has been turned off, i.e., has ended detecting the preceding sheet S1. If the CPU 203 determines that the full stack detection sensor 160 has not been turned off (NO in step S1204), the process returns to step S1204. If the CPU 203 determines that the full stack detection sensor 160 has ended detecting the preceding sheet S1 (YES in step S1204), the process proceeds to step S1205. In step S1205, the CPU 203 starts measuring the sheet-to-sheet interval. In step S1206, the CPU 203 determines whether the full stack detection sensor 160 has detected the subsequent sheet S2. If the CPU 203 determines that the full stack detection sensor 160 has not detected the subsequent sheet S2 (NO in step S1206), the process returns to step S1206. If the CPU 203 determines that the full stack detection sensor 160 has detected the subsequent sheet S2 (YES in step S1206), the process proceeds to step S1207. In step S1207, the CPU 203 ends measuring the sheet-to-sheet interval. In step S1208, the CPU 203 stores the value of the measured sheet-to-sheet interval in a storage number N' in a storage area 1' in the storage unit 204. In step S1209, the CPU 203 increments the storage number N' by 1. The storage area and the storage number may be arbitrarily set.

In step S1210, the CPU 203 compares the storage number N in which the sheet-to-sheet interval detected by the conveyance path sensor 105 is stored, and the storage number N' in which the sheet-to-sheet interval detected by the full stack detection sensor 160 is stored. If the storage number N' is smaller than the storage number N (YES in step S1210), the process returns to step S1204, where the processes of steps S1204 to step S1209 are repeated. On the other hand, if the storage numbers N and N' are the same, or the storage number N' is greater than the storage number N (NO in step S1210), the process proceeds to step S1211. In step S1211, the CPU 203 compares the sheet-to-sheet interval detected by the conveyance path sensor 105 with the sheet-to-sheet interval detected by the full stack detection sensor 160. The CPU 203 then determines whether to widen the sheet-to-sheet interval. At step S1212 from step 1211, the process ends. The determination process will be described in detail below.

Figure 6:
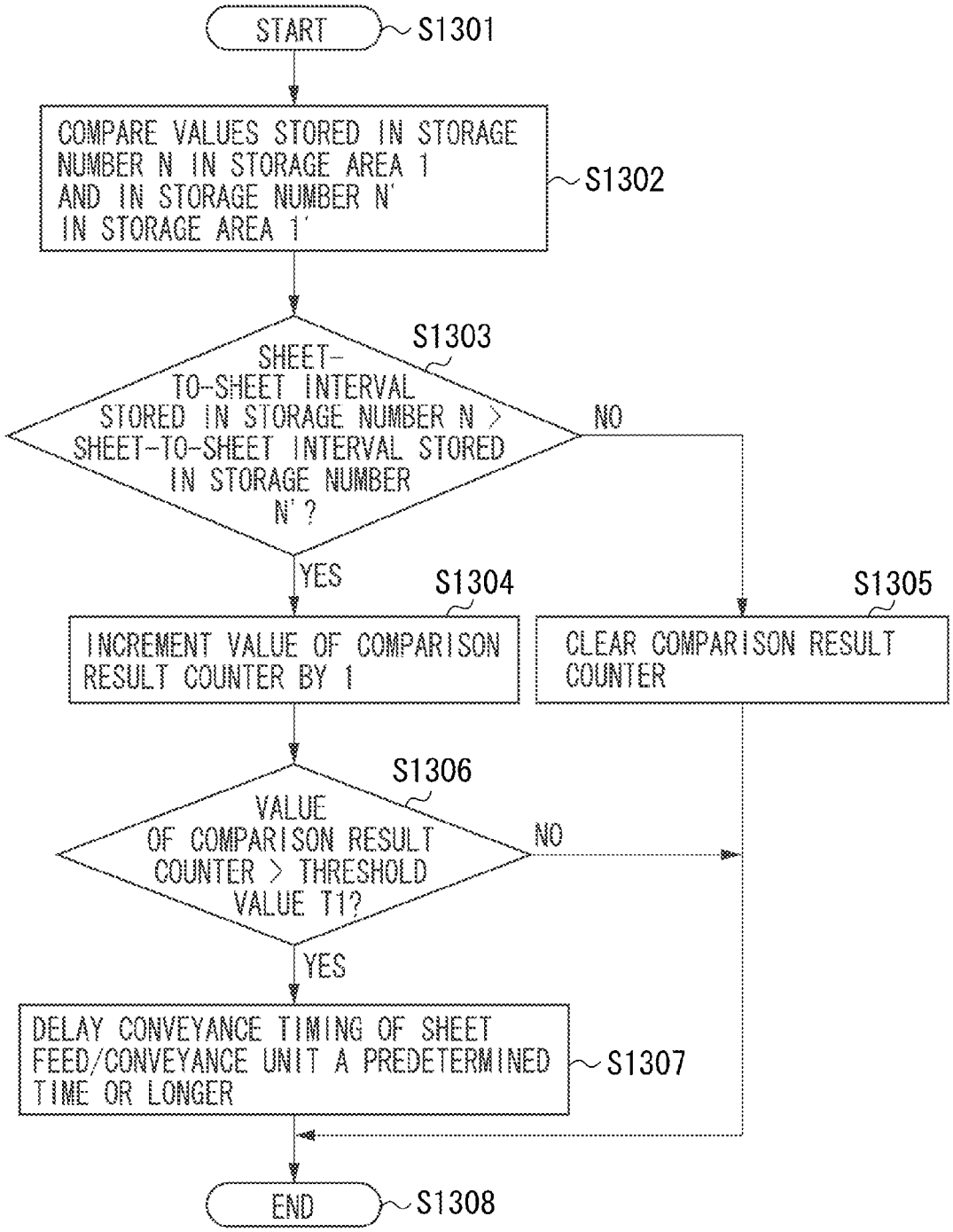
FIG. 6 is a flowchart illustrating a process for determining whether to widen the sheet-to-sheet interval to reduce false detection by the full stack detection sensor according to a first exemplary embodiment.

FIG. 6 is a flowchart illustrating a process for determining whether to widen the sheet-to-sheet interval for reducing false detection by the full stack detection sensor 160. In step S1301, the CPU 203 starts comparing the sheet-to-sheet intervals. In step S1302, the CPU 203 compares, among the sheet-to-sheet intervals stored in the storing unit 204, the values of the sheet-to-sheet intervals stored in the storage number N in the storage area 1 and in the storage number N' in the storage area 1'.

In step S1303, the CPU 203 determines whether the value of the sheet-to-sheet interval stored in the storage number N, detected by the conveyance path sensor 105, is greater than the value of the sheet-to-sheet interval stored in the storage number N', detected by the full stack detection sensor 160. If the CPU 203 determines that the value of the sheet-to-sheet interval detected by the conveyance path sensor 105 is greater than the value of the sheet-to-sheet interval detected by the full stack detection sensor 160 (YES in step S1303), the process proceeds to step S1304. In step S1304, the CPU 203 increments the value of a comparison result counter by 1. If the value of the sheet-to-sheet interval detected by the conveyance path sensor 105 is less than or equal to the value of the sheet-to-sheet interval detected by the full stack detection sensor 160 (NO in step S1303), the process proceeds to step S1305. In step S1305, the CPU 203 clears the value of the comparison result counter and the process proceeds to step S1308.

In step S1306, the CPU 203 determines whether the value of the comparison result counter is greater than a predetermined threshold value T1. For example, the threshold value T1 is set to 20. In such a case, if the sheet-to-sheet interval detected by the full stack detection sensor 160 is detected 20 consecutive times to be shorter than that detected by the conveyance path sensor 105, the CPU 203 determines that the predetermined time for the full stack detection sensor 160 to detect the fully-stacked state cannot be secured. The case where the threshold value T1 is set to 20 is an example. The threshold value T1 may be arbitrarily changed according to conditions such as accuracy of the full stack detection sensor 160, and accuracy and configuration demanded in performing full-stack detection.

If the CPU 203 determines that the value of the comparison result counter is not greater than a predetermined threshold value T1 (NO in step S1306), then the process proceeds to step S1308. If the CPU 203 determines that the value of the comparison result counter is greater than the predetermined threshold value T1 (YES in step S1306), the process proceeds to step S1307. In step S1307, the CPU 203 secures the time necessary for the full stack detection sensor 160 to detect the fully-stacked state by delaying the conveyance timing of the recording medium S by a predetermined time. For example, it is assumed that the time necessary for the full stack detection sensor 160 to detect the fully-stacked state is 50 ms, and the sheet-to-sheet interval detected by the full stack detection sensor 160 is 30 ms. In such a case, the time necessary for detecting the fully-stacked state can be secured by delaying the conveyance timing of the recording medium S by 20 ms or longer. The above-described values are examples, and the time by which the conveyance timing of the recording medium S is delayed may be arbitrarily set according to conditions such as accuracy of the full stack detection sensor 160 and accuracy and configuration demanded in performing full-stack detection. At step 1308 from step S1305, S1306, or S1307, the process ends.

Further, when the CPU 203 determines to widen the sheet-to-sheet interval to secure the time necessary for detecting the fully-stacked state, the recording media S may still be remaining in the image forming apparatus. In such a case, the CPU 203 may widen the sheet-to-sheet interval after discharging all of the recording media S remaining in the image forming apparatus, instead of immediately increasing the sheet-to-sheet interval. When the recording media S remaining in the image forming apparatus are to be discharged, the full stack detection sensor 160 may also be set not to detect the fully-stacked state. The full stack detection sensor 160 then restarts detecting the fully-stacked state from the recording medium S conveyed after widening the sheet-to-sheet interval. The user may selectively set whether to detect the fully-stacked state when discharging the remaining recording media S.

As described above, if it is determined that the full stack detection sensor 160 may perform false detection of the fully-stacked state based on the sheet-to-sheet interval detected by the full stack detection sensor 160, the sheet-to-sheet interval is controlled. As a result, false detection by the full stack detection sensor 160 can be reduced.

Figure 7:
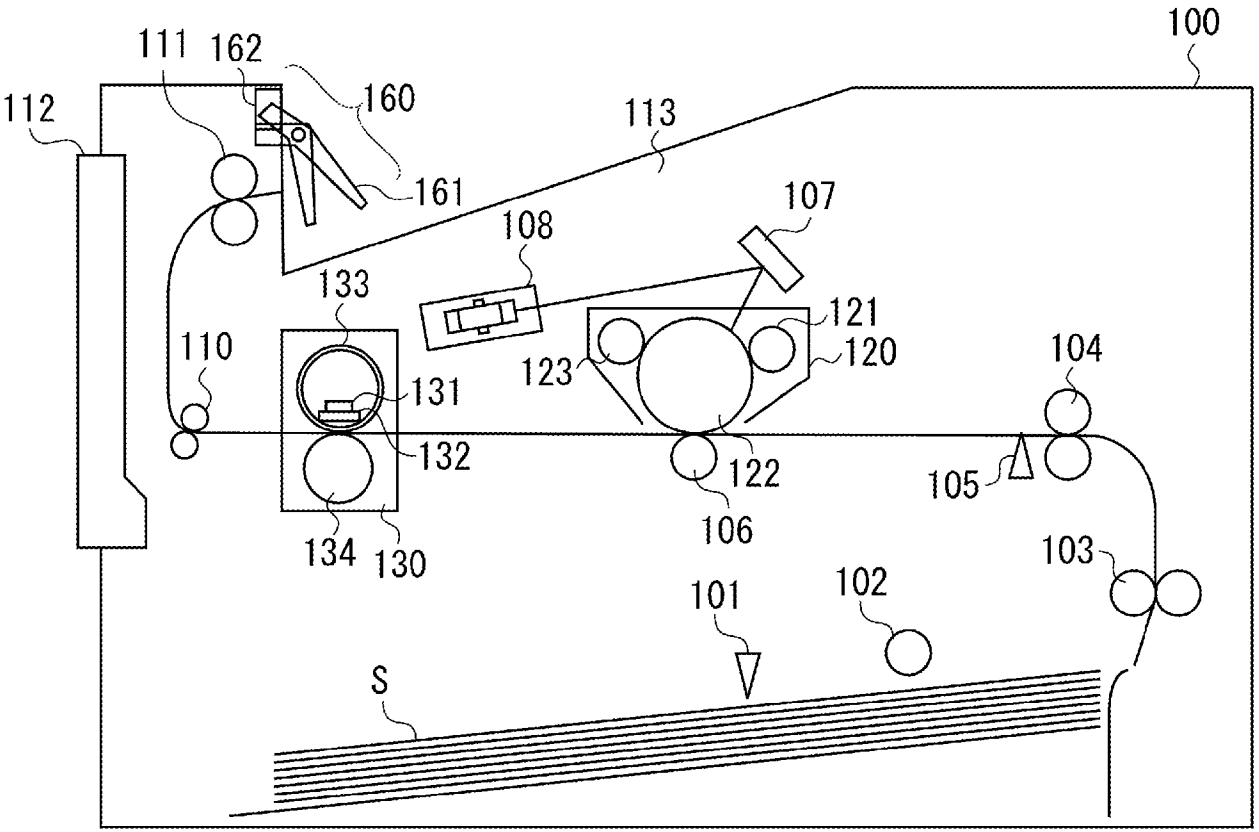
FIG. 7 is a schematic diagram illustrating a configuration of an image forming apparatus in which the full stack detection sensor is also used as a sheet discharge sensor.

The control method of the full stack detection sensor 160 may be applied to an image forming apparatus in which the full stack detection sensor 160 is also used as the sheet discharge sensor 109. FIG. 7 illustrates an image forming apparatus in which the full stack detection sensor 160 is used as the sheet discharge sensor 109. Referring to FIG. 7, the basic configuration is similar to the image forming apparatus illustrated in FIG. 1. However, the image forming apparatus illustrated in FIG. 7 does not include a sheet discharge sensor 109, and the full stack detection sensor 160 performs the function of the sheet discharge sensor 109. In such a configuration, the false detection by the full stack detection sensor 160 can be reduced by controlling the sheet-to-sheet interval according to the result of detecting the interval between the preceding sheet S1 and the subsequent sheet S2 by the full stack detection sensor 160.

According to the first exemplary embodiment, if it is detected that the sheet-to-sheet interval detected by the full stack detection sensor 160 is shorter than the sheet-to-sheet interval detected by the conveyance path sensor 105 a predetermined number of times or more, the timing of feeding the recording medium S is delayed by a predetermined time. According to a second exemplary embodiment, the number of detections is determined to be within a threshold value T2. In such a case, if it is detected that the sheet-to-sheet interval detected by the full stack detection sensor 160 is shorter than the sheet-to-sheet interval detected by the conveyance path sensor 105 a number of times equivalent to or exceeding a threshold value T3, the timing of feeding the recording medium S is delayed for a predetermined time. Description on configurations similar to the first exemplary embodiment will be omitted.

Figure 8:
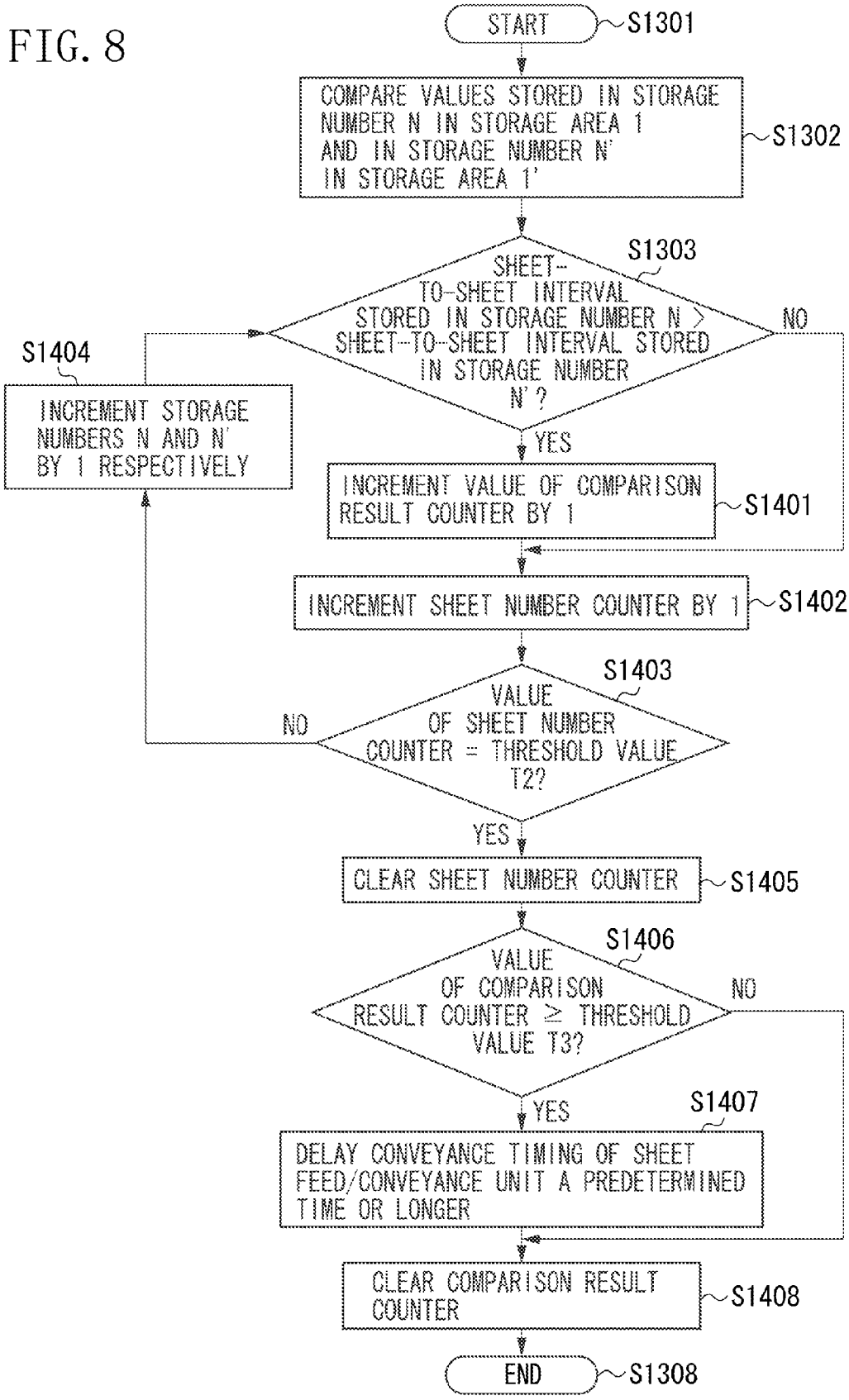
FIG. 8 is a flowchart illustrating a process for determining whether to widen the sheet-to-sheet interval to reduce false detection by the full stack detection sensor according to a second exemplary embodiment.

FIG. 8 is a flowchart illustrating a process for determining whether to widen the sheet-to-sheet interval to reduce false detection by the full stack detection sensor 160. The processes similar to the flowchart illustrated in FIG. 6 according to the first exemplary embodiment will be assigned the same step numbers, and description will be emitted.

Since the processes of step S1301 to step S1302 are similar to those illustrated in FIG. 6, description will be omitted. If the value of the sheet-to-sheet interval detected by the conveyance path sensor 105 is less than or equal to the value of the sheet-to-sheet interval detected by the full stack detection sensor 160 (NO in step S1303), the process proceeds to step S1402. If the CPU 203 determines that the value of the sheet-to-sheet interval detected by the conveyance path sensor 105 is greater than the value of the sheet-to-sheet interval detected by the full stack detection sensor 160 (YES in step S1303), the process proceeds to step S1401. In step S1401, after the CPU 203 determines in step S1303 that the value of the sheet-to-sheet interval detected by the conveyance path sensor 105 is greater than that detected by the full stack detection sensor 160, the CPU 203 increments the value of the comparison result counter by 1 and the process proceeds to step S1402. In step S1402, the CPU 203 increments a value of a sheet counter by 1. In step S1403, the CPU 203 determines whether the value of the sheet counter has reached the threshold value T2. If the value of the counter has not reached the threshold value T2 (NO in step S1403), the process proceeds to step S1404. In step S1404, the CPU 203 increments the storage number N and the storage number N' by 1 respectively. The process then returns to step S1303, and the CPU 203 continues to compare the sheet-to-sheet intervals. On the other hand, if the value of the sheet counter has reached the threshold value T2 (YES in step S1403), the process proceeds to step S1405. In step S1405, the CPU 203 clears the sheet counter.

In step S1406, the CPU 203 compares the value of the comparison result counter and the threshold value T3 to determine whether the value of the comparison result counter is equal to or greater than the threshold value T3. If the CPU 203 determines that the value of the comparison result counter is not equal to or greater than the threshold value T3, the process proceeds to step S1408. If the value of the comparison result counter is equal to or greater than the threshold value T3 (Yes in step S1406), the process proceeds to step S1407. In step S1407, the CPU 203 delays the conveyance timing of the recording medium S by a predetermined time, so that the time necessary for the full stack detection sensor 160 to detect the fully-stacked state can be secured and the process proceeds to step S1408. In step S1408, the CPU 203 clears the value of the comparison result counter. At step S1308 from step S1408, the process ends.

The threshold value T2 compared with the value of the sheet counter and the threshold value T3 compared with the value of the comparison result counter in the above-described flowchart maybe appropriately set using the graph illustrated in FIG. 3. As described above, the graph illustrated in FIG. 3 indicates the difference value between the sheet-to-sheet intervals detected by the conveyance path sensor 105 and the full stack detection sensor 160. For example, referring to the result of the difference values illustrated in FIG. 3, it is assumed that the full stack detection sensor 160 may perform false detection when the value of the sheet-to-sheet interval detected by the conveyance path sensor 105 becomes greater than that detected by the full stack detection sensor 160 in 8 out of 10 detections of the sheet-to-sheet interval. In such a case, the threshold value T2 is set to 10 and the threshold value T3 to 8. If the value of the sheet-to-sheet interval detected by the conveyance path sensor 105 then becomes greater than the sheet-to-sheet interval detected by the full stack detection sensor 160 in 8 out of 10 detections of the sheet-to-sheet interval, the conveyance timing of the recording medium S is delayed by a predetermined time, e.g., 20 ms or more. The time necessary for detecting the fully-stacked state can thus be secured. The above-described numerical values are taken as an example, and the time by which the conveyance timing of the recording medium S is delayed may be arbitrarily set according to conditions such as accuracy of the full stack detection sensor 160 and accuracy and configuration demanded in performing full-stack detection.

As described above, when the full stack detection sensor 160 detects the interval a predetermined number of times, the sheet-to-sheet interval detected by the full stack detection sensor 160 may be shorter than the sheet-to-sheet interval detected by the conveyance path sensor 105, a predetermined number of times or more. In such a case, the sheet-to-sheet interval can be controlled, so that an unexpected false detection by the full stack detection sensor 160 due to stacking failure and noise can be reduced.

According to a third exemplary embodiment, the difference values between the sheet-to-sheet intervals detected by the conveyance path sensor 105 and the full stack detection sensor 160 are averaged. If the averaged difference value becomes equal to or greater than a threshold value T4, the timing of feeding the recording medium S is delayed by a predetermined time as described below. Description on configurations similar to the first exemplary embodiment will be omitted.

Figure 9:
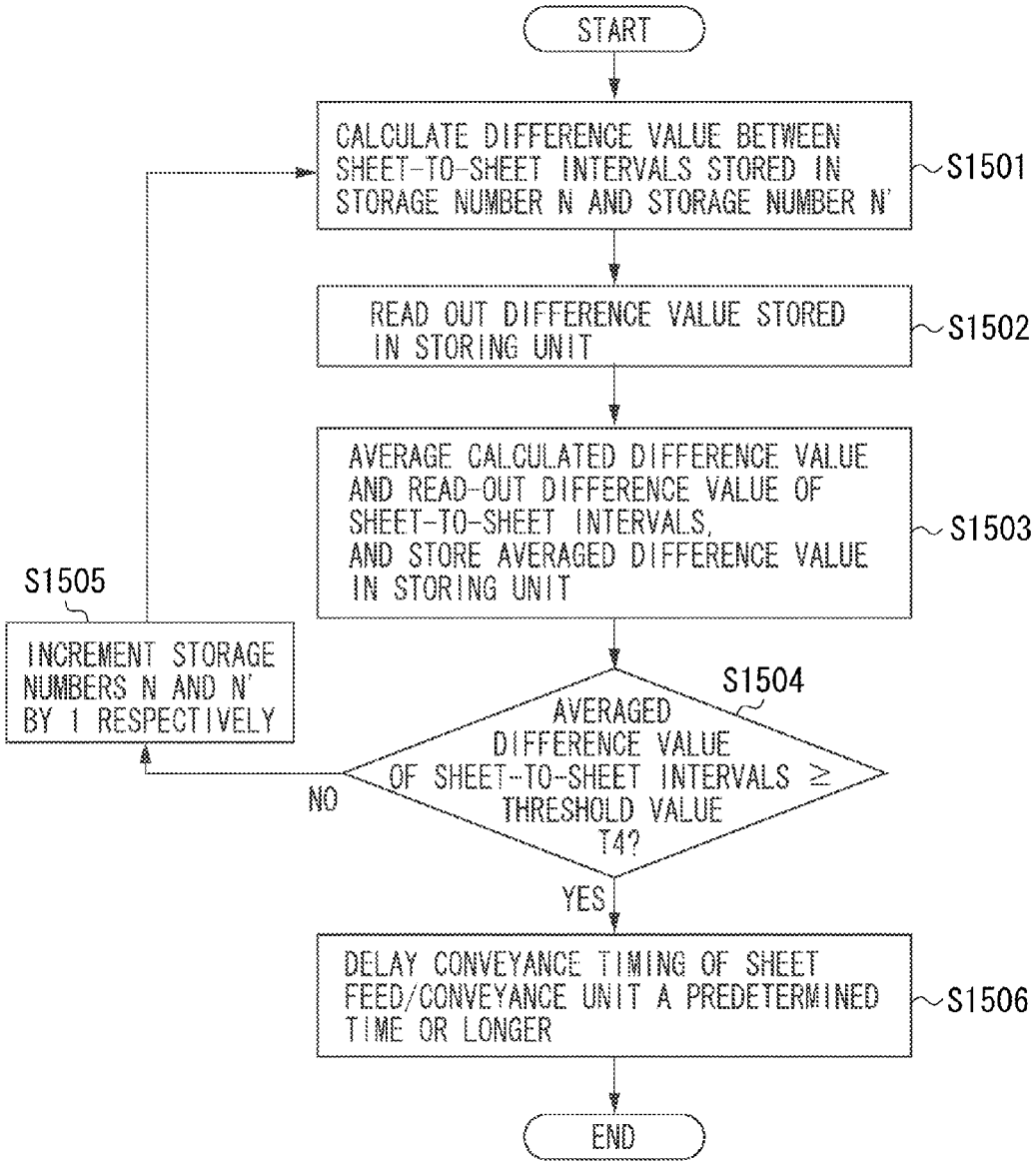
FIG. 9 is a flowchart illustrating a process for determining whether to widen the sheet-to-sheet interval to reduce false detection by the full stack detection sensor according to a third exemplary embodiment.

FIG. 9 is a flowchart illustrating a process for determining whether to widen the sheet-to-sheet interval to reduce false detection by the full stack detection sensor 160. In step S1501, the CPU 203 calculates the difference value between the sheet-to-sheet interval stored in the storage number N, detected by the conveyance path sensor 105, and the sheet-to-sheet interval stored in the storage number N', detected by the full stack detection sensor 160. In step S1502, the CPU 203 reads out the previously calculated difference values between the sheet-to-sheet intervals detected by the conveyance path sensor 105 and the full stack detection sensor 160 stored in the storing unit. In step S1503, the CPU 203 averages the difference value calculated in step S1501 and the previously calculated difference values read out in step S1502 and stores the averaged value in the storage area. Since the difference values can be averaged by adding the calculated difference values and dividing the sum by the number of calculations, a detailed description will be omitted.

In step S1504, the CPU 203 compares the averaged difference value and the threshold value T4 to determine whether the averaged difference value is equal to or greater than the threshold value T4. If the averaged difference value is less than the threshold value T4 (NO in step S1504), the process proceeds to step S1505. In step S1505, the CPU 203 increments the storage number N and the storage number N' by 1 respectively. The process then returns to step S1501, and the CPU 203 continues to calculate the difference values between the sheet-to-sheet intervals. On the other hand, if the averaged difference value is equal to or greater than the threshold value T4 (YES in step S1504), the process proceeds to step S1506. In step S1506, the CPU 203 delays the conveyance timing of the recording medium S by a predetermined time. The time necessary for the full stack detection sensor 160 to detect the fully-stacked state can thus be secured. The process may end from step S1506.

The threshold value T4 compared with the averaged difference value may be appropriately set using the graph indicating the difference value between the sheet-to-sheet intervals detected by the conveyance path sensor 105 and the full stack detection sensor 160 illustrated in FIG. 3. For example, referring to the result of the difference values illustrated in FIG. 3, it is assumed that the full stack detection sensor 160 may perform false detection when the sheet-to-sheet interval detected by the full stack detection sensor 160 becomes shorter than the sheet-to-sheet interval detected by the conveyance path sensor 105 by 10 mm or more. In such a case, the threshold value T4 is set to 10 mm. If the averaged difference value then becomes equal to or greater than the threshold value T4, the conveyance timing of the recording medium S is delayed by a predetermined time, e.g., 20 ms or longer. As a result, the time necessary for the full stack detection sensor 160 to detect the fully-stacked state can be secured. The above-described numerical values are taken as an example, and the time by which the conveyance timing of the recording medium S is delayed may be arbitrarily set according to conditions such as accuracy of the full stack detection sensor 160 and accuracy and configuration demanded in performing full-stack detection.

As described above, the sheet-to-sheet interval is controlled based on the averaged value of the difference between the sheet-to-sheet intervals detected by the conveyance path sensor 105 and the full stack detection sensor 160. Unexpected false detection by the full stack detection sensor 160 due to stacking failure and noise can thus be reduced.

According to the third exemplary embodiment, the difference value between the sheet-to-sheet intervals detected by the conveyance path sensor 105 and the full stack detection sensor 160 is averaged. When the averaged difference value becomes equal to or greater than the threshold value T4, the timing of feeding the recording medium S is delayed by a predetermined time. According to a fourth exemplary embodiment, a method for delaying the timing of feeding the recording medium S by a predetermined time, when the averaged difference value becomes equal to or greater than the threshold value T4 and when a maximum difference value between the sheet-to-sheet intervals detected by the conveyance path sensor 105 and the full stack detection sensor 160 becomes equal to or greater than a threshold value T5, will be described below. Description on configurations similar to the first exemplary embodiment will be omitted.

Figure 10:
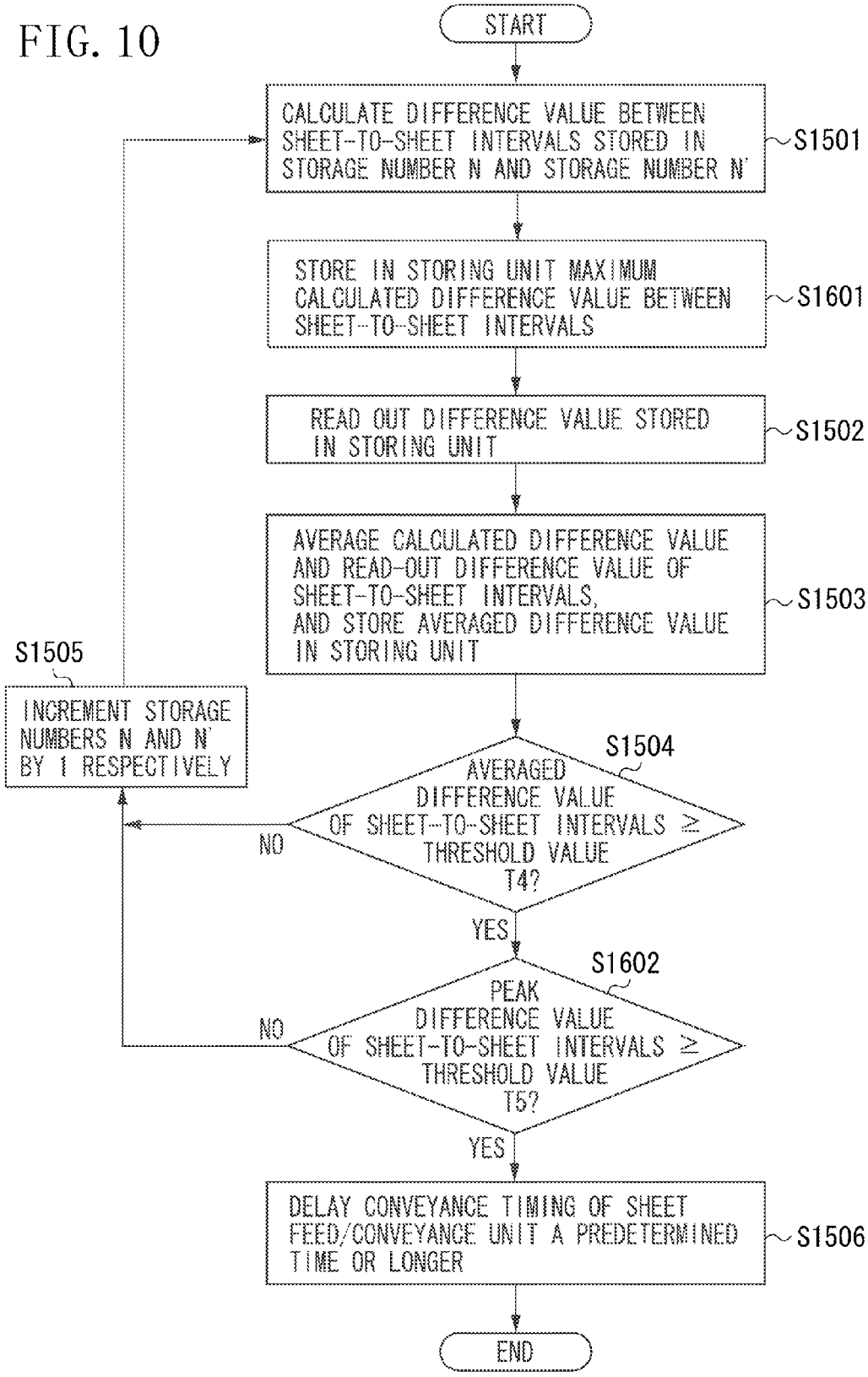
FIG. 10 is a flowchart illustrating a process for determining whether to widen the sheet-to-sheet interval to reduce false detection by the full stack detection sensor according to a fourth exemplary embodiment.

FIG. 10 is a flowchart illustrating a process for determining whether to widen the sheet-to-sheet interval to reduce false detection by the full stack detection sensor 160. The processes similar to the flowchart illustrated in FIG. 9 according to the third exemplary embodiment will be assigned the same step numbers, and description will be emitted.

Step S1501 proceeds to step S1601. In step S1601, the CPU 203 compares the difference value between the sheet-to-sheet intervals calculated in step S1501 and the difference value stored in the storing unit. The CPU 203 then stores in the storing unit the greater difference value as a peak of the difference value. The process then proceeds from step S1601 to step S1502, from step S1502 to step S1503, and from step S1503 to step S1504. If the averaged difference value is equal to or greater than the threshold value T4 (YES in step S1504), the process proceeds to step S1602. In step S1602, if the CPU 203 has determined that the averaged difference value is equal to or greater than the threshold value T4 in step S1504, the CPU 203 compares the peak difference value of the sheet-to-sheet interval stored in the storing unit with the threshold value T5. If the peak difference value is smaller than the threshold value T5 (NO in step S1602), the process proceeds to step S1505. In step S1505, the CPU 203 increments the storage number N and the storage number N' by 1 respectively. The process then returns to step S1501, and the CPU 203 continues to calculate the difference values between the sheet-to-sheet intervals. On the other hand, if the peak difference value is equal to or greater than the threshold value T5 (YES in step S1602), the process proceeds to step S1506. In step S1506, the CPU 203 delays the conveyance timing of the recording medium S by a predetermined time. The time necessary for the full stack detection sensor 160 to detect the fully-stacked state can thus be secured. From step S1506, the process ends.

The threshold value T4 compared with the averaged difference value and the threshold value T5 compared with the peak of the difference value may be appropriately set using the graph in FIG. 3 illustrating the difference values between the sheet-to-sheet intervals detected by the conveyance path sensor 105 and the full stack detection sensor 160. For example, referring to the result of the difference values illustrated in FIG. 3, it is assumed that the full stack detection sensor 160 may perform false detection when the sheet-to-sheet interval detected by the full stack detection sensor 160 becomes shorter than the sheet-to-sheet interval detected by the conveyance path sensor 105 by 10 mm or more. In such a case, the threshold value T4 is set to 10 mm. Further, it is assumed that the full stack detection sensor 160 may perform false detection when the difference value between the sheet-to-sheet intervals detected by the conveyance path sensor 105 and the full stack detection sensor 160 becomes 15 mm or greater. In such a case, the threshold value T5 is set to 15 mm. If the averaged difference value then becomes equal to or greater than the threshold value T4, and the peak difference value becomes equal to or greater than the threshold value T5, the conveyance timing of the recording medium S is delayed by a predetermined time, e.g., 20 ms or longer. As a result, the time necessary for the full stack detection sensor 160 to detect the fully-stacked state can be secured. The above-described numerical values are taken as an example, and the time by which the conveyance timing of the recording medium S is delayed may be arbitrarily set according to conditions such as accuracy of the full stack detection sensor 160 and accuracy and configuration demanded in performing full-stack detection.

As described above, the sheet-to-sheet interval is controlled based on the averaged difference value between the sheet-to-sheet intervals detected by the conveyance path sensor 105 and the full stack detection sensor 160, and the peak difference value between the sheet-to-sheet intervals. Unexpected false detection by the full stack detection sensor 160 due to stacking failure and noise can thus be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-088796 filed Apr. 7, 2010, which is hereby incorporated by reference herein in its entirety.

What is claimed is:

1. An image forming apparatus, comprising:

an image forming unit configured to form an image on a recording medium;

a stacking unit configured to stack recording media on which images are formed by the image forming unit;

a first detection unit configured to detect a conveyance interval between a trailing edge of a first recording medium that is first conveyed and a leading edge of a second recording medium conveyed subsequent to the first recording medium;

a second detection unit disposed downstream of the first detection unit with respect to a conveying direction of a recording medium and configured to detect the conveyance interval and detect whether an amount of recording media stacked on the stacking unit exceeds a predetermined amount; and a control unit configured to control, according to a result of comparing the conveyance interval detected by the first detection unit and the conveyance interval detected by the second detection unit, a conveyance interval between a trailing edge of a preceding recording medium and a leading edge of a succeeding recording medium so that the conveyance interval between the trailing edge of the preceding recording medium and the leading edge of the succeeding recording medium is wider than the conveyance interval detected by the first detection unit in a case where a third recording medium subsequent to the second recording medium is conveyed.

2. The image forming apparatus according to claim 1, wherein the second detection unit is a sensor that detects whether recording media are fully stacked on the stacking unit.

3. The image forming apparatus according to claim 2, wherein, in a case where the second detection unit detects that the recording media are fully stacked on the stacking unit, the control unit stops an image forming process performed by the image forming unit.

4. The image forming apparatus according to claim 1, wherein, in a case where it is detected that the conveyance interval detected by the second detection unit is shorter than the conveyance interval detected by the first detection unit a continuous number of times exceeding a first threshold value, the control unit increases the conveyance interval between the trailing edge of the preceding recording medium and the leading edge of the succeeding recording medium so that the conveyance interval between the trailing edge of the preceding recording medium and the leading edge of the succeeding recording medium is wider than the conveyance interval detected by the first detection unit in a case where a third recording medium subsequent to the second recording medium is conveyed.

5. The image forming apparatus according to claim 1, wherein, in a case where the conveyance interval is detected a number of times that is determined as a second threshold value, and where it is detected that the conveyance interval detected by the second detection unit is shorter than the conveyance interval detected by the first detection unit a number of times equivalent to or exceeding a third threshold value, the control unit increases the conveyance interval between the trailing edge of the preceding recording medium and the leading edge of the succeeding recording medium so that the conveyance interval between the trailing edge of the preceding recording medium and the leading edge of the succeeding recording medium is wider than the conveyance interval detected by the first detection unit in a case where a third recording medium subsequent to the second recording medium is conveyed.

6. The image forming apparatus according to claim 1, wherein, in a case where difference values of the conveyance intervals detected by the first detection unit and the second detection unit are averaged, and the averaged difference value is equal to or greater than a fourth threshold value, the control unit increases the conveyance interval between the trailing edge of the preceding recording medium and the leading edge of the succeeding recording medium so that the conveyance interval between the trailing edge of the preceding recording medium and the leading edge of the succeeding recording medium is wider than the conveyance interval detected by the first detection unit in a case where a third recording medium subsequent to the second recording medium is conveyed.

7. The image forming apparatus according to claim 6, wherein, in a case where a maximum value of difference values between the conveyance intervals detected by the first detection unit and the second detection unit is equal to or greater than a fifth threshold value, the control unit increases the conveyance interval between the trailing edge of the preceding recording medium and the leading edge of the succeeding recording medium so that the conveyance interval between the trailing edge of the preceding recording medium and the leading edge of the succeeding recording medium is wider than the conveyance interval detected by the first detection unit in a case where a third recording medium subsequent to the second recording medium is conveyed.

8. The image forming apparatus according to claim 1, wherein the control unit determines that recording media are fully stacked in a case where a detection result is not changed when a predetermined period has passed since the second detection unit detects a leading edge of a recording medium.

9. The image forming apparatus according to claim 1, wherein the control unit measures an interval between recording media by measuring a period until a detection result of detecting a trailing edge of a recording medium by the second detection unit is changed.

10. An image forming apparatus, comprising:

an image forming unit configured to form an image on a recording medium;

a stacking unit configured to stack recording media on which images are formed by the image forming unit;

a first detection unit configured to detect a conveyance interval between a trailing edge of a first recording medium that is first conveyed and a leading edge of a second recording medium conveyed subsequent to the first recording medium;

a second detection unit disposed downstream of the first detection unit with respect to a conveying direction of a recording medium and configured to detect the conveyance interval and detect whether an amount of recording media stacked on the stacking unit exceeds a predetermined amount; and a control unit configured to control, according to a result of comparing the conveyance interval detected by the first detection unit and the conveyance interval detected by the second detection unit, a conveyance interval between a trailing edge of the second recording medium and a leading edge of a third recording medium conveyed subsequent to the second recording medium so that the conveyance interval between the trailing edge of the second recording medium and the leading edge of the third recording medium is wider than the conveyance interval detected by the first detection unit.

* * * * *